US005428949A

United States Patent [19]

Stahlecker

[11] Patent Number: 5,428,949

[45] Date of Patent: Jul. 4, 1995

[54] FITTING FOR AN OPENING ROLLER OF AN OPEN-END SPINNING DEVICE

[75] Inventor: Fritz Stahlecker, Bad Überkingen, Germany

[73] Assignee: Hans Stahlecker, Sussen, Germany

[21] Appl. No.: 155,142

[22] Filed: Nov. 22, 1993

[30] Foreign Application Priority Data

Nov. 28, 1992 [DE] Germany ..... 42 40 026.0

[51] Int. Cl.[6] ..... D01H 4/32

[52] U.S. Cl. ..... 57/408; 19/114

[58] Field of Search ..... 57/408, 409, 410, 411, 57/412, 413; 19/112, 114

[56] References Cited

U.S. PATENT DOCUMENTS

| | | | |
|---|---|---|---|
| 2,937,412 | 5/1960 | Hollingsworth | 19/114 |
| 3,387,338 | 6/1968 | Kanai et al. | 19/114 |
| 3,391,429 | 7/1968 | Watanabe | 19/114 |
| 4,044,427 | 8/1977 | Ankrom et al. | 19/112 X |
| 4,858,275 | 8/1989 | Stahlecker et al. | 57/408 X |
| 5,164,236 | 11/1992 | Schmid | 57/408 X |

FOREIGN PATENT DOCUMENTS

| | | | |
|---|---|---|---|
| 2180269 | 3/1987 | United Kingdom | 19/114 |

*Primary Examiner*—Joseph J. Hail, III

*Attorney, Agent, or Firm*—Evenson McKeown Edwards & Lenahan

[57] ABSTRACT

In the case of a fitting for an opening roller of an open-end spinning device, it is provided that several rows of teeth extend essentially in circumferential direction of the opening roller. The teeth rows are separated from each other by grooves. The lateral flanks of the teeth extend over the groove base in to the lateral flanks of the neighboring row of teeth. The lateral flanks of the teeth, as well as the groove base are provided with a structured surface. The teeth tips connecting the lateral flanks are not provided with this structured surface.

11 Claims, 3 Drawing Sheets

FITTING FOR AN OPENING ROLLER OF AN OPEN-END SPINNING DEVICE

BACKGROUND AND SUMMARY OF THE INVENTION

The invention relates to a fitting for an opening roller of an open-end spinning device. The opening roller has several rows of teeth, extending essentially in circumferential direction of the opening roller, each of the teeth rows being separated by a groove which has a groove base, the lateral flanks of the teeth having a structured or textured surface and extending into the lateral flanks of the neighboring row.

In the case of a fitting of this kind (Germany Patent Document DE 40 38 352 A1), the lateral flanks of the teeth are provided with a patterning produced by means of surface tooling and resulting in a surface structure. The aim is, by means of this patterning, to create a surface which allows a good taking-along effect of the fibers, without however the fibers being affected to such a degree that dust particles are scraped off. The construction of the fitting and in particular the shape of the teeth has a considerable influence on the spinning result. The opening roller serves to separate fed-in fiber material, in the form of a sliver, into single fibers, which are then fed into a spinning element. The sliver is fed in at the relatively low speed of about one meter per minute, while the teeth of the fitting move at a considerably higher speed of, for example, 30 meters per second. The teeth of the fitting therefore penetrate at a very high speed into the sliver end, the so-called fiber beard, whereby they comb the fiber beard out and in this way separate out the single fibers.

An object of the invention is to make a fitting which gives an even better spinning result.

This object is achieved according to the invention in that the groove base is also provided with a structured surface.

The invention is based on the knowledge that some of the fibers are not only transported through the lateral flanks of the teeth, but on the groove base of the opening roller. If the fibers rest perfectly flat in contact with the surface of the groove base, this impedes the removal of fibers from the opening roller and their feeding into the spinning element. If, however, the groove base is provided also with a structured or textured surface, then the fibers there cannot rest flat, so that they can be drawn away by the suction air stream effecting the fiber transport and in this way they come away easier from the groove base.

In a further development of the invention it is provided that the teeth tips connecting the lateral flanks will not have a structured surface. The protection of the teeth tips by means of treatment of the teeth is known from German Patent Document DE 33 32 804 A1.

In relation to the mass of the teeth, the teeth tips have a very large surface area. If the teeth tips were not excluded from the structured surface area, they would, with the application of a structured surface receive the highest effect, which would be disadvantageous. A structured surface on the groove base, however, does not significantly alter the basic character of the fitting.

In the production of the preferred embodiments of the inventive fitting the structured surface is optimally applied to the fitting where it is only really necessary. The teeth tips should not be provided with the structured surface, so that they are not greatly affected and so do not become uneven.

The structured surface can be brought about chemically or mechanically by means of the use of a corroding substance, whereby the teeth tips are protected. This can be done in that the teeth tips are impregnated with a suitable substance. For example, the fitting can be treated in a shallow bath, whereby the teeth tips are simply wetted with an impregnating substance. In so far as embodiments of fittings with a ring mounting are concerned, it is contemplated to thread the ring mounting onto a shaft and to wet it by means of a transmitter roller. The ring mounting and the transmitter roller can then both rotate.

A small tank containing the impregnating substance can be attached to the transmitter roller. It is also an advantage for the transmitter roller to have a fitting which is suitable for taking up the impregnating substance and depositing it on the teeth tips. A brush with short bristles or alternatively, a textile coating which is absorbent enough, is suitable for this. The impregnating of the teeth tips can also be achieved by means of a suitable paste or powder.

In further new developments of the invention a coating is placed on the structured surface. Although in some cases an uncoated fitting is sufficient for the technical spinning requirements, it is advantageous to coat the fitting with, for example, the usual nickel-diamond coating, in particular when spinning fiber material which contains a synthetic mixture. It is sufficient when the structuring is only partially maintained, that is, it does not matter if the original structuring becomes burnished while being coated.

When, however, a specific amount of the structuring should remain intact, then the original structuring can be accentuated so that after treatment enough of the structure remains intact to be effective.

The structure is advantageous in that it consists of notches and waves. It is therefore not so important to make the structured surface particularly even.

Expediently the groove base opposite the lateral flanks of the teeth is deepened. Through this process the grooves in the area of the groove base are provided with a continuous small wall on the sides, which is advantageous for the guiding of the fibers.

In a particularly advantageous new development of the invention the fitting is formed from a base body by means of a cutting process. This has the advantage that, in contrast to the standard saw-tooth wires, the teeth, in their teeth form, can be better adapted to the technical spinning requirements.

Expediently the groove base may have an almost semi-circular cross-section. With this configuration the loose fibers can be removed more easily from the fitting.

Other objects, advantages and novel features of the present invention will become apparent from the following detailed description of the invention when considered in conjunction with the accompanying drawings.

DETAILED DESCRIPTION OF THE DRAWINGS

Figure 1:
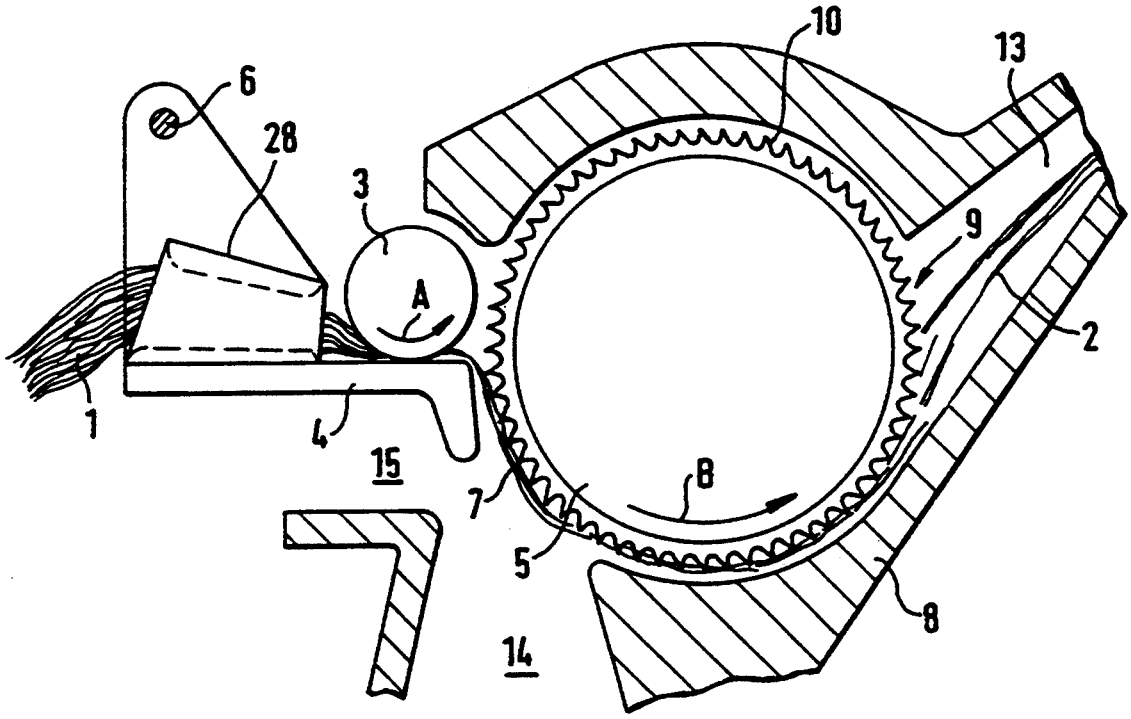
FIG. 1 is a sectional view showing an opening-device for an open-end spinning device, constructed according to a preferred embodiment of the invention.

The opening device shown in FIG. 1 serves to feed in a sliver 1 and to separate it into individual fibers 2. The individual fibers 2 are then transported pneumatically (not shown) to a spinning element, e.g. a spinning rotor, in which they are bundled and twisted together into a yarn, which is then continuously withdrawn.

A relatively slow rotating feed roller 3 (in arrow direction A) which is attached to a feed table 4 with condenser 28, delivers the sliver 1 with delivery speed to an opening roller 5 rotating (in arrow direction B) at a much higher speed. The feed table 4 is pivotally supported on a stationary shaft 6 and pressed with spring elements (not shown) onto the feed roller 3, so that a nipping gap is formed between the feed roller 3 and the feed table 4.

The feed roller 3 and the feed table 4 present the sliver 1, fed in at a speed of approx. 1 meter per second, to the opening roller 5 in the form of a fiber beard 7.

Figure 3:
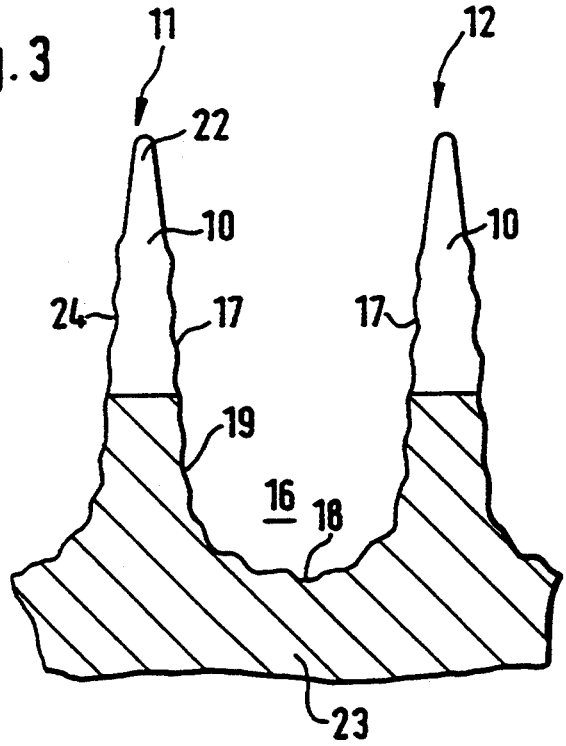
FIG. 3 is a very enlarged cross-section through part of a fitting constructed according to the preferred embodiments of the invention.

The opening roller 5, surrounded by its housing 8, is provided with a fitting 9 on its circumference, which fitting consists of a larger number teeth 10 which are arranged mainly in circumferential direction in circular rows 11, 12, one behind the other (see FIG. 3).

The process of coiling a saw-tooth wire as a fitting 9 around the circumference of the opening roller 5 is known. This coiling is done in the form of spirals. The grinding-in of the teeth into the circumference of the opening roller 5 or in the circumference of a ring mounting which is part of an opening roller is also known, whereby parallel rows 11, 12 of teeth 10 are formed, situated in planes inclined to the axis of the opening roller 5.

The opening roller 5 runs at 5000–8000 revolutions per minute, whereby the teeth 10 rotate at a circumferential speed of up to 30 meters per second. The teeth 10 of the fitting 9 penetrate the fiber beard 7 and comb it out, thereby pulling out individual fibers 2 from the fiber beard 7 as soon as the taking-along effect of the opening roller 5 is greater than the force keeping back the fibers 2. The fibers 2 are then accelerated further along the circumference of the opening roller 5 and after approximately 180°, they are fed through a fiber-feed channel 13, which is tangentially attached to the opening roller 5, to a spinning element.

The accelerating of the fibers 2 takes place by means of the friction force brought about by the teeth 10 of the fitting 9 and is supported by air streams, which are caused by the opening roller 5 and which are additionally accelerated by an underpressure downstream of the end of the fiber feed channel 13. Air streams are hereby sucked in through an impurity removal opening and an air-inlet opening.

During the transport around the circumference of the opening roller 5, the fibers 2 are to be found in grooves 16 between the teeth 10 (see also FIGS. 2 & 3), whereby they are accelerated in circumferential direction B, in particular because of the friction from the flanks 17 of the teeth 10 and the groove base 18.

The grooves 16 having a round groove base 18 are first of all bordered by closed teeth bases 19, from which the actual teeth 10 rise, each of which has a tooth face 20, a tooth back 21, two lateral flanks 17 as well as a connecting tooth tip 22. As can be seen further in FIG. 2, the cross-section of the teeth 10 tapers in radial direction up to the flattened teeth tips 22.

In order to be able to adjust the production of the teeth 10 in accordance with the fiber material to be spun, the teeth 10 are preferably worked out of a base body 23 by means of a cutting process, e.g., grinding. The base body 23 can be a ring mounting, which is an interchangeable part of the opening roller 5.

In order that the best possible effective taking-along of the fibers 2 through the fitting 9 is guaranteed, without the single fibers 2 being significantly damaged, the lateral flanks 17 of the teeth 10 are provided with a special structured surface 24 (see in particular FIG. 3). With this special structured surface 24, which can, for example, be formed by grooves and waves, the possible contact area with the fibers 2 is enlarged, which improves the friction taking-along. The inventor has determined that such a structured surface 24 should not only be provided on the lateral flanks 17, but also in the groove base 18, and further, because of reasons already mentioned, the teeth tips 22 should not be provided with the structured surface.

Figure 2:
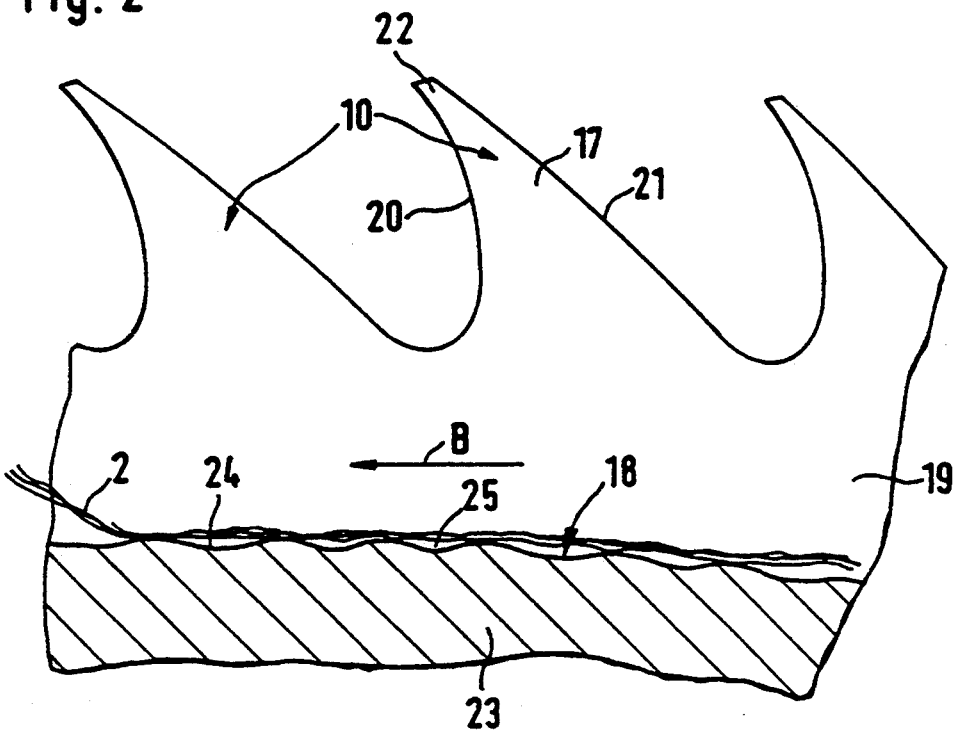
FIG. 2 is a very enlarged longitudinal section through the area of the fitting of the opening roller of FIG. 1.

The effect of the structured surface 24 in a groove base 18 will be explained below with the aid of FIG. 2:

It is recognized that the shown fibers 2 do not conform to the waviness of the structured surface 24 of the groove base 18 and therefore do not rest perfectly flat on the groove base 18. As a result of this, small little hollows 25 form under the fibers 2, whereby the fibers 2 can be sucked away by suction air. This results in the fibers 2 being able to rise better from the groove base 18 in the area of the fiber feed channel 13.

Figure 4:
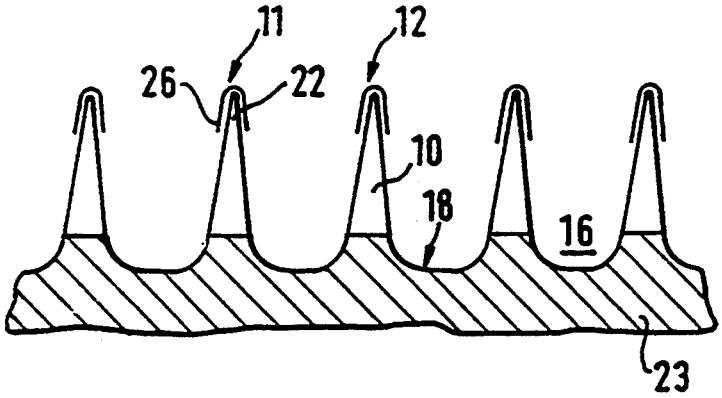
FIGS. 4–7 are part cross-sections similar to FIG. 3, depicting the production process of the structured surface according to the invention.

The production process of the structured surface 24 is explained below with the aid of FIGS. 4–7:

In FIG. 4, the starting position is shown, in which the individual teeth 10 of the rows 11, 12 together with intermediate grooves 16 having groove bases 18 are worked out of a base body 23 by means of a cutting process. It is shown diagrammatically that each tooth tip 22 is covered with an impregnating substance 26. Attention is expressly drawn to the fact that the impregnation of the teeth 10 is only shown schematically, and that in practice, this impregnation may be invisible to the naked eye.

Figure 5:
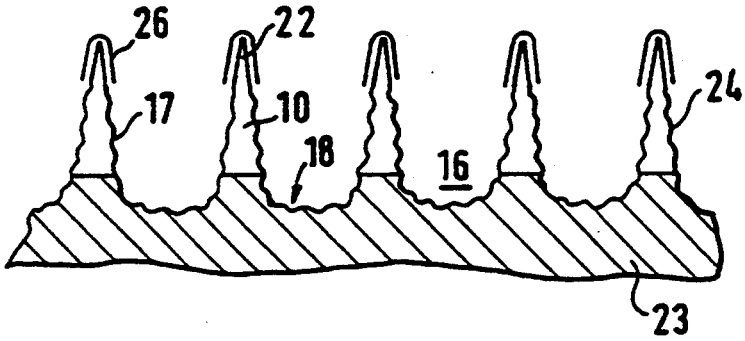

According to FIG. 5, the base body 23, in the form of a ring mounting, together with the teeth 10, is provided chemically or mechanically with the structured surface 24 on the lateral flanks 17 and in the groove base 18, whereby the teeth tips 22 are sufficiently protected by the impregnation 26 so that they are excluded from the structured surface process. The structured surface 24 can also be maintained by means of, for example, spark erosion or laser eradication. An alternative possibility is the grinding of groove or wave-shaped notches.

Figure 6:
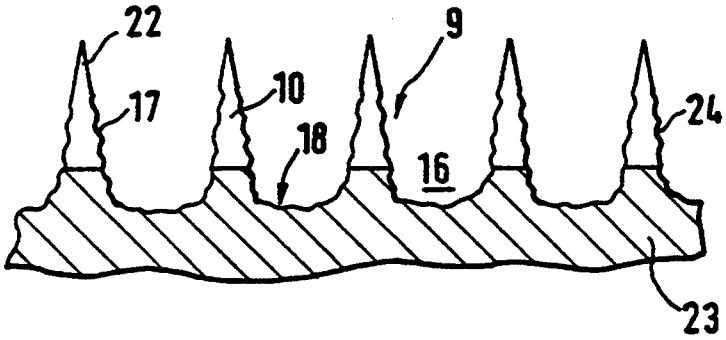

In the process step depicted in FIG. 6, the impregnating substance 26 is removed, whether through washing or mechanical treatment of the teeth 10. The teeth tips 22 lie free, having no structured surface 24, in contrast to the lateral flanks 17 and the groove base 18. In some cases, a fitting 9 in the same condition according to FIG. 6, can be used.

Figure 7:
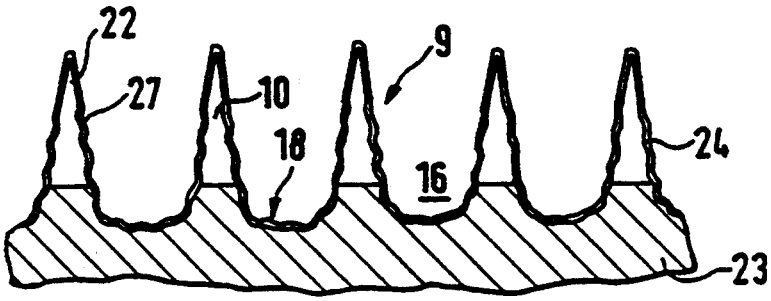

In the last process step depicted in FIG. 7, a coating 27 is additionally placed on the entire fitting 9, that is, on the teeth 10 and the groove base 18. This can be done preferably in a known way with a nickel-diamond coating, whereby a nickel matrix with laid in diamond grains is applied to the fitting 9 of alloyed steel.

As a rule, the structured surface 24 becomes almost flattened due to the coating 27. It remains, however, intact due to the very thin application of the coating 27. It is sufficient when the structured surface 24 is only partially maintained.

In contrast to the described procedures according to FIGS. 4–7, as an alternative, the operation shown in FIG. 6, namely the removal of the impregnating substance 26 can be dispensed with before the final application of a coating 27.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A fitting for an opening roller of an open end spinning device, comprising:

a plurality of rows of teeth extending essentially in a circumferential direction of the opening roller, adjacent rows of teeth being separated by a groove with a groove base and lateral walls, said teeth having lateral flanks which merge into respective lateral walls of respective adjacent grooves, and a structured roughened surface only provided on said teeth over substantially the entire surface of the groove base, the lateral walls of the grooves, and a major part of the teeth flanks from the groove lateral walls to a position spaced from radial tip portions of the teeth, whereby the roughened surface at the groove base, groove lateral walls, and the teeth lateral flanks serves to assure fibers transport during operation of the opening roller and avoid fiber resting flat on surfaces of the grooves.

2. Fitting according to claim 1, wherein a coating is placed on the structured surface.

3. A fitting according to claim 2, wherein a coating is placed on the structured surface.

4. A fitting according to claim 2, wherein the groove base has a nearly semi-circular cross-section.

5. Fitting according to claim 1, wherein the structured surface consists of notches and waves.

6. Fitting according to claim 1, wherein the groove base is disposed radially inward of the teeth lateral flanks.

7. A fitting according to claim 6, wherein the structured surface consists of notches and waves.

8. Fitting according to claim 1, wherein the teeth are integral with a base body and formed by a cutting process.

9. A fitting according to claim 8, wherein the groove base in respect to the lateral flanks is deepened.

10. Fitting according to claim 1, wherein the groove base has a nearly semi-circular cross-section.

11. A fitting according to claim 10, wherein the teeth are integral with a base body and formed by a cutting process.

* * * * *